US007345640B2

(12) United States Patent
Watari et al.

(10) Patent No.: US 7,345,640 B2
(45) Date of Patent: Mar. 18, 2008

(54) INVISIBLE ANTENNA

(75) Inventors: Toru Watari, Matsudo (JP); Toshiyuki Ando, Hitachi (JP); Toshiyuki Takano, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 44 days.

(21) Appl. No.: 11/272,055

(22) Filed: Nov. 14, 2005

(65) Prior Publication Data

US 2006/0109187 A1 May 25, 2006

(30) Foreign Application Priority Data

Nov. 12, 2004 (JP) ..... 2004-328839

(51) Int. Cl.
*H01Q 1/32* (2006.01)
*H01Q 1/02* (2006.01)

(52) U.S. Cl. ..... 343/713; 343/711; 343/704

(58) Field of Classification Search ..... 343/713, 343/704, 711
See application file for complete search history.

(56) References Cited

U.S. PATENT DOCUMENTS 5,307,076 A * 4/1994 Murakami et al. ..... 343/704
5,801,663 A * 9/1998 Lindenmeier et al. ..... 343/704
5,959,586 A * 9/1999 Benham et al. ..... 343/713
6,384,790 B2 * 5/2002 Dishart et al. ..... 343/713
6,693,597 B2 * 2/2004 Walton et al. ..... 343/713

FOREIGN PATENT DOCUMENTS

| | | |
|---|---|---|
| JP | 8-242114 | 9/1996 |
| JP | 11-145717 | 5/1999 |
| JP | 2000-174529 | 6/2000 |

* cited by examiner

*Primary Examiner*—Hoang V. Nguyen
*Assistant Examiner*—Robert Karacsony
(74) *Attorney, Agent, or Firm*—McGinn IP Law Group, PLLC

(57) ABSTRACT

An invisible antenna with excellent antenna characteristics that cannot be visually recognized by naked eyes. A pair of linear conductors 11 are connected to a feeding line 12, and a plurality of the linear conductors 11 are disposed on and/or within a transparent insulating layer 14. The linear conductor 11 cannot be visually recognized by human naked eyes.

11 Claims, 8 Drawing Sheets

INVISIBLE ANTENNA

The present application is based on Japanese Patent Application No. 2004-328839 filed on Nov. 12, 2004, the entire contents of which are incorporated herein by reference.

BACKGROUND OF THE INVENTION

1. Field of the Invention

The present invention relates to an invisible antenna for radio communication, which receives a VHF band, UHF band, etc., in more particularly, to an invisible antenna with a reduced visibility of an antenna device.

2. Description of the Related Art

Conventionally, when considering a half wavelength dipole antenna as antenna device for transmitting and receiving a VHF band (30 to 300 MHz), UHF band (300 MHz to 3 GHz), etc., an antenna device 30 comprising a pair of conductor plates 31, 31 and a feeder part 32 connected to the conductor plates 31, 31 may be provided as shown in FIG. 1.

Herein, the conductor plate 31 can be composed of a pipe material or wire rod. A total length L of the conductor plates is various, however, as for a most theoretical length, the length L is the ½ wavelength. For example, the length L becomes about 300 mm (L=300 mm) for a 500 MHz band, since the wavelength is 600 mm. For this case, a width W of the conductor plate is generally more than several millimeters for the practical dimension.

In addition, FIG. 2 shows another type of a conventional antenna device 30 in which a passive element 33 is disposed with a predetermined distance from conductor plates 31, 31 to adjust directional characteristics. FIG. 3 shows an antenna device 30, in which a pair of triangular conductor plates 31*a*, 31*a* are positioned in symmetry to provide a bow tie configuration, so as to broaden a bandwidth of a resonance frequency. FIG. 4 shows a conventional antenna device 30, in which a pair of fan-shaped conductor plates 31*b*, 31*b* are positioned in symmetry to provide a bow tie configuration, so as to broaden a bandwidth of the resonance frequency.

However, in the conventional antenna device 30 for example shown in FIG. 1, the width W of the conductor plate 31 is several millimeters and the length L is about 300 mm for the 500 MHz band. Since the width N and the length L are large, the antenna device 30 is visible by human naked eyes. For example, if an installation site of the antenna device 30 is a perimeter of a television receiver or inside of a car, the existence of the antenna device may be an issue in a total design matching.

In addition, film-shaped antennae have been commercialized. However, when the film-shaped antenna is stuck on a glass window of a house or car, the existence of the antenna device may become an issue in the total design matching. When the antenna device occupies a large area, it may become one of visual field blockage factors. Conventional film-shaped antennae are disclosed in Japanese Patent Laid-Open (Kokai) Nos. 2000-174529 (JP-A-2000-174529), 11-145717 (JP-A-11-145717), and 8-242114 (JP-A-8-242114).

For solving the above problems, as shown in FIG. 5, it is necessary to make a width of linear conductors 21, 21 extremely small, such that the linear conductors 21, 21 are not in a visible state. However, such a configuration is accompanied with an increase in a conductor resistance, thereby occurring a loss in electric wave transmission and reception characteristics, which is an important function of the antenna device.

In other words, it is necessary for the length L of the linear conductors 21, 21 to be about ½ wavelength to tune the resonance frequency in the dipole antenna. However, when the width W of the linear conductor 21 is made small, the conductor resistance is increased, so that the conductor resistance becomes dominant in an input impedance of the antenna. As a result, there is a disadvantage in that an impedance matching with a feeder part 22 becomes impossible, thereby deteriorating the antenna characteristics.

Accordingly, it is an object of the invention to provide an invisible antenna with excellent antenna characteristics, which cannot be recognized visually by the human naked eyes.

According to a first feature of the invention, an invisible antenna, comprises:

a transparent insulating layer; and a plurality of conductors disposed on and/or in the transparent insulating layer for radiating or receiving electric wave, the conductor being invisible by human eyes.

Further, the conductor may be a linear conductor.

It is preferable that a diameter of the conductor is 0.1 mm or less. It is more preferable that a diameter of the conductor is 0.08 mm or less.

Still further, the invisible antenna may further comprise a feeding line connected to a pair of the conductors, wherein the conductors are disposed in parallel with each other.

In addition, the invisible antenna may further comprise a feeding line connected to a pair of the conductors, wherein each of the conductors is provided with an angle different with each other to a reference line.

An angle between adjacent ones of the conductors may be different with each other. The angle between adjacent ones of the conductors may be equal to each other. Each of the conductors may be provided with a length different with each other.

Further, the conductors may be crisscrossed with each other.

Still further, the conductors may be formed on and/or in the insulating layer by a mechanical process. The conductors may be formed on and/or in the insulating layer by a chemical process.

Furthermore, it is preferable that a projection width of the conductor on a plane observed by human eyes is 0.1 mm or less, and a pitch between adjacent ones of the conductors on the plane is more than ten times of the diameter of the conductor or the projection width of the conductor at the narrowest.

The projection width of the conductor may be 0.08 mm or less.

According to an invisible antenna of the present invention, since extremely thin linear conductors are disposed planarly with a large pitch, a visual recognition of the antenna device by human naked eyes becomes almost impossible, so that the installation condition of the antenna device will not become an issue in the total design matching. In addition, while the antenna device may be provided in various shapes in accordance with its application, the invisible antenna of the present invention can be freely formed in any shape, since the visibility of the antenna device becomes almost none.

BRIEF DESCRIPTION OF THE DRAWINGS

Preferred embodiments of the present invention will be explained in conjunction with appended drawings, wherein:

FIGS. 6A and 6B are diagrams showing an invisible antenna in a first preferred embodiment according to the present invention, wherein FIG. 6A is a plan view of the invisible antenna and FIG. 6B is a cross sectional view of the invisible antenna shown in FIG. 6A cut along line A-A';

FIGS. 7A and 7B are enlarged cross sectional views of the invisible antenna shown in FIG. 6A, wherein FIG. 7A shows a state the linear conductors are formed in an insulating layer, and FIG. 78 shows a state that the linear conductors are formed on the insulating layer;

FIGS. 10A and 10B are diagrams showing an invisible antenna in a fourth preferred embodiment according to the present invention, wherein FIG. 10A is a plan view of the invisible antenna and FIG. 10B is a cross sectional view of the invisible antenna shown in FIG. 10A cut along line A-A'.

DETEILED DESCRIPTION OF THE PREFERRED EMBODIMENTS

Next, an invisible antenna in preferred embodiments of the present invention will be explained in conjunction with the appended drawings.

Firstly, in the present application, a term "invisible" means at least two following states.

(1) where the conductors are difficult to be visually recognized, and (2) where the conductors are not possible to be visually recognized.

Figure 6A:
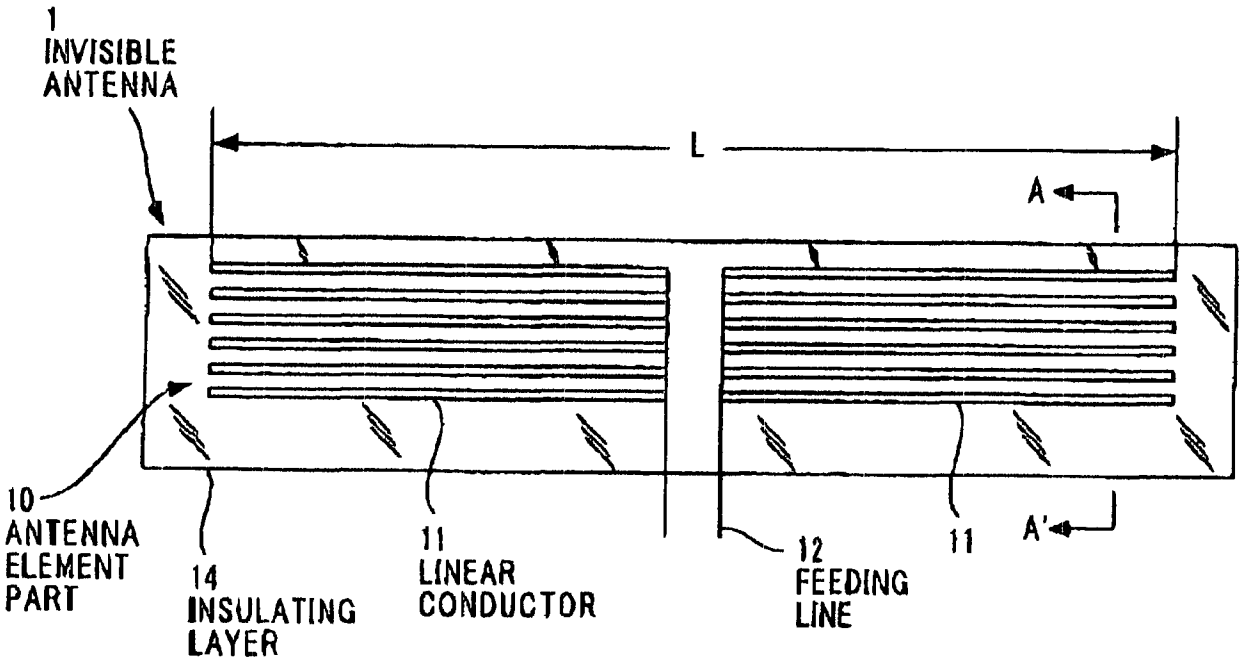
Figure 6B:
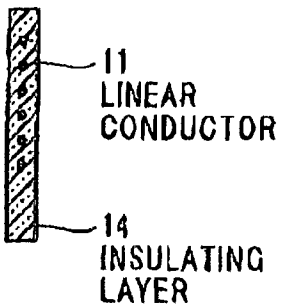

FIGS. 6A and 6B are diagrams showing an invisible antenna in a first preferred embodiment according to the present invention, wherein FIG. 6A is a plan view of the invisible antenna 1 and FIG. 6 is a cross sectional view of the invisible antenna 1 shown in FIG. 6A cut along line A-A'.

In an invisible antenna 1 shown in FIG. 6A, the number N of thin linear conductors 11 having a wire diameter of 0.1 mm, preferably 0.08 mm or less are disposed in an insulating layer 14 with an excellent optical transparency to form an antenna element part 10. This antenna element part 10 is connected collectively to a feeding line 12, which is connected to a receiver (not shown) or a power source (not shown) to provide the invisible antenna 1.

The linear conductors 11 are composed of plural thin lines (wires), and the linear conductors 11 are disposed symmetrically as to regard the feeding line 12. A length L of a pair of the linear conductors 11 is determined as e.g. about ½ wavelength of a frequency of a receiving/radiating electric wave of the invisible antenna 1.

For example, assuming this invisible antenna 1 as a receiving antenna, electric current is induced in each one of the thin lines, and a receiving electric power can be provided through the feeding line 12.

The linear conductors 11 with the number N have an equal length, so that the electric powers supplied from respective lines are synthesized to have a common mode (in-phase) in the feeding line 12.

Figure 1:
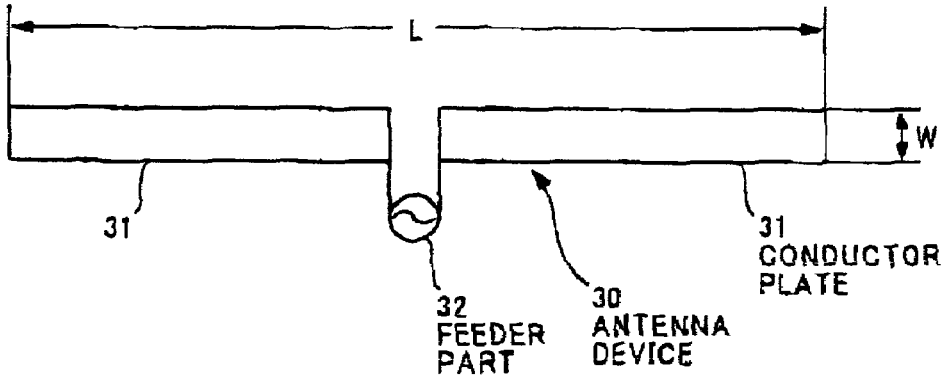
FIG. 1 PRIOR ART
FIG. 1 is a plan view showing a conventional dipole antenna.

If the number N becomes large, the antenna element part 10 comprising a batch of the linear conductors 11 will become approximately equivalent with a conductor plate 31 shown in FIG. 1, and electric wave receiving functions of both the antenna devices will approach to each other. From this fact, an operation of the antenna element part 10 in FIG. 6A will be understood.

Herein, the linear conductor 11 has a high resistance value since the respective lines are thin. However, the linear conductors 11 with the number N are connected collectively by the feeding line 12, thereby providing a parallel circuit.

Therefore, considering the antenna device 1 as an antenna composed of the antenna element part 10 comprising the linear conductors 11 with the number N and a feeding line 12, a resistance value of each of the linear conductors 11 providing a heat loss will be synthesized parallel and will be reduced to 1/N Accordingly, the impedance matching of the antenna element part 10 and the feeding line 12 can be realized easily by choosing the number of the linear conductors 11 appropriately.

For example, assuming an antenna device for 500 MHz band (a wavelength of 600 mm) with a length L of ½ wavelength (wavelength/2=300 mm) by using a copper wire with a diameter d of 0.01 mm (d=0.01 mm), a high frequency resistance along the length L of the conductors 11 will be 263Ω, wherein N=1. This high frequency resistance value is much greater than 73.13Ω that is a radiation resistance of the antenna device 1, so that a heat loss will become large. When the number N is 100 (N=100), the high frequency resistance will be reduced to be 2.6Ω, so that the heat loss becomes to a level that can be ignored. At this time, if a conductor pitch P is assumed e.g. 0.2 mm, a width occupied by the linear conductors 11 is 19.81 mm, so that a dimension of the antenna device 1 becomes a dimension of a general antenna.

Figure 7A:
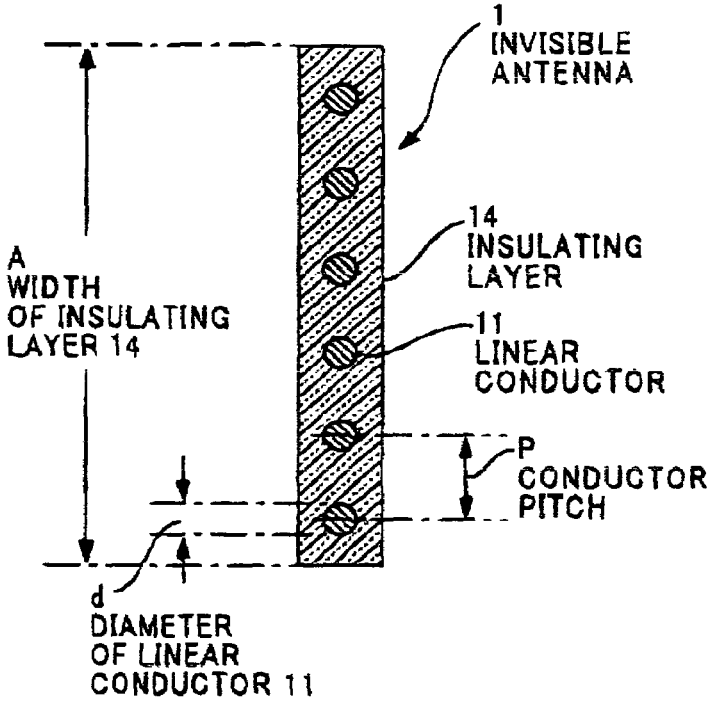
Figure 7B:
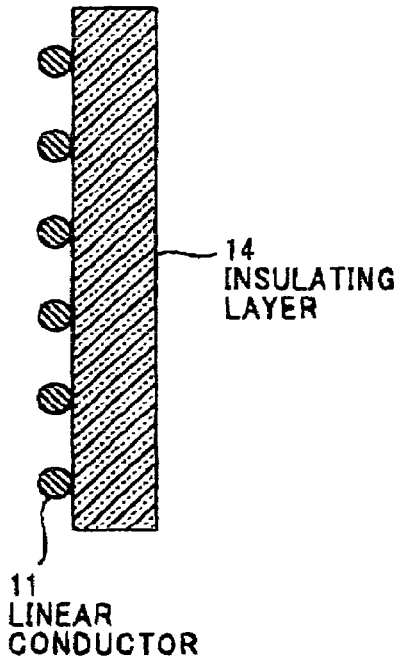

FIGS. 7A and 7B are enlarged cross sectional views of the invisible antenna shown in FIG. 6A, wherein FIG. 7A shows a state the linear conductors are formed in an insulating layer, and FIG. 7B shows a state that the linear conductors are formed on the insulating layer. FIG. 7A is a diagram for explaining the visibility of the antenna device 1, wherein a cross section of the linear conductor 11 has a circular shape, a conductor diameter is d, a conductor pitch is P, a number of conductors is N, and a width of the insulating layer 14 is A.

Herein, the diameter d is 0.1 mm or less, more preferably 0.08 mm or less, since the visual recognition becomes difficult with an ordinary recognition capacity of human naked eyes under this condition. Therefore, a projection width of the linear conductor 11 on a plane to be visually observed is 0.1 mm or less, preferably 0.08 mm or less.

In addition, when a part of a light transmitting through the insulating layer 14 having a width A is obstructed by the linear conductors 11 with the number N, shadows of the linear conductors 11 are formed, so that the linear conductors 11 will become visible as a result.

A degree of this shadow can be expressed as SR as follows:

$$P = A/N$$

$$SR\ (\mathrm{dB}) = 10 \times \mathrm{Log}_{10}\ (A/Nd) = 10 \times \mathrm{Log}_{10}\ (P/d)$$

In general, due to the human vision capacity, if the diameter d is greater than SR=10 dB, the visual recognition by the human naked eyes will become difficult. For this reason, it is necessary to satisfy that P/d is 10 or more ($P/d \geqq 10$). In other words, the pitch P between the adjacent linear conductors on a plane visually observed should be more than 10 times the diameter d or the projection width of the linear conductor at the narrowest.

In addition, a technique of composing an antenna device by using plural conductors is generally used in the field of antenna device for a short wavelength band using a low frequency. However, the object of such an antenna device is to prevent an increase in a device weight or an increase in a received wind pressure due to a device dimension for the long wavelength, rather than reducing the heat loss due to the conductor resistance. Therefore, the technical role of the antenna device according to the present invention is completely different from that of the antenna device for the short wavelength band FIG. 7A shows an example in which the plural linear conductors 11 are disposed coplanarly in the insulating layer 14, so that the plural linear conductors 11 are arranged in a same plane. However, the present invention is not limited thereto. The respective linear conductors 11 may not be disposed in the same plane.

FIG. 7B shows an example where the plural linear conductors 11 are provided on a surface of the insulating layer 14. The linear conductors 11 may be provided anywhere including a front surface and a back surface. Accordingly, the linear conductors 11 can be disposed on and/or in the insulating layer 14, In addition, the feeding line 12 does not have an adverse effect, since the length thereof is short even if the feeding line 12 is visible by human naked eyes However, for making the feeding line 12 invisible, a diameter of the feeding line 12 should be 0.1 mm or less. For this case, the feeding lines 12 should be arranged in parallel since the resistance value at an input side is increased.

Figure 8:
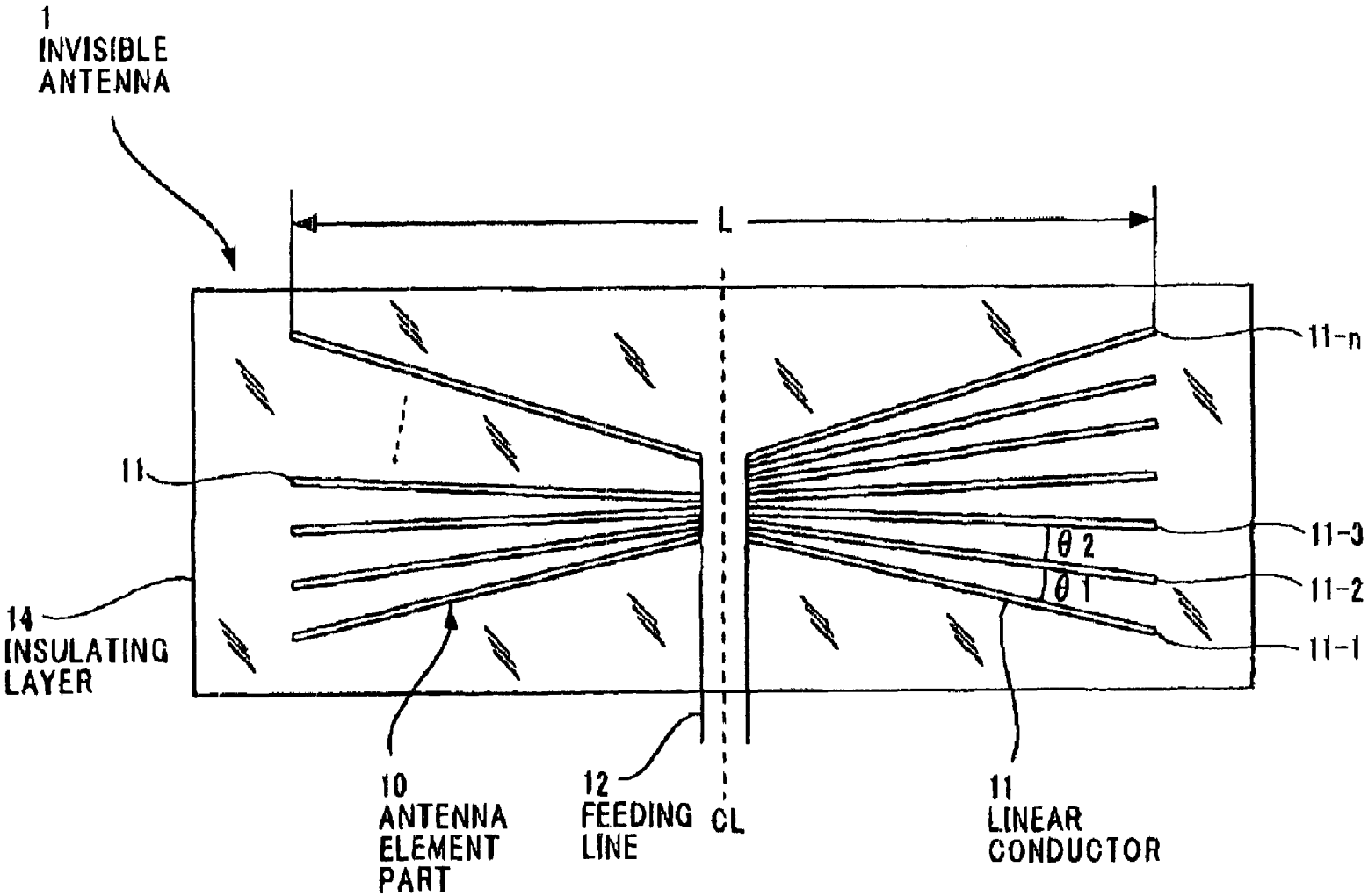
FIG. 8 is a plan view showing an invisible antenna in a second preferred embodiment according to the invention.

FIG. 8 is a plan view showing an invisible antenna in a second preferred embodiment according to the invention.

In FIG. 8, each of linear conductors 11 with a diameter of 0.1 mm or less composing an antenna element part 10 is provided with an angle different with each other to provide a bow tie configuration. In other words, the linear conductors 11 are arrayed on the insulating layer 14. Simultaneously, each pair of the linear conductors 11 is provided with an equal length L (for example, ½ wavelength), and disposed on the insulating layer 14 to constitute an invisible antenna device 1. Herein, the length L is a distance between both ends of the pair of the linear conductors 11.

Herein, the angle of the each linear conductor 11 is an angle as regard to a predetermined reference line provided on an insulating layer 14. In FIG. 8, a centerline CL is provided for example at a center of the insulating layer 14 that is parallel with the feeding lines 12.

Further, the angles between the adjacent linear conductors 11 might be different with each other. For example, adjacent linear conductors 11-1 and 11-2 are positioned with an angle $\theta_1$, and adjacent linear conductors 11-2 and 11-3 are positioned with an angle $\theta_2$, wherein the angles $\theta_1$ and $\theta_2$ are different with each other.

Still further, the angles between the adjacent linear conductors 11 might be equal with each other. For example, the angle $\theta_1$ between the linear conductors 11-1 and 11-2 and the angle $\theta_2$ between the linear conductors 11-2 and 11-3 might be equal to each other.

Figure 3:
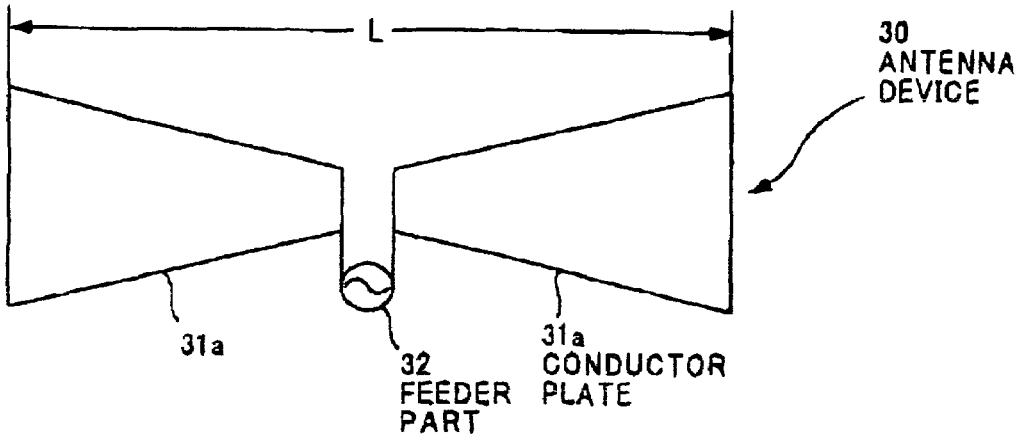
FIG. 3 PRIOR ART
FIG. 3 is a plan view showing a conventional dipole antenna having a bow tie configuration.

According to the invisible antenna 1 in the second preferred embodiment, it is possible to achieve an operation similar to that of the conventional antenna device 30 (half wavelength dipole antenna) having a bow tie configuration shown in FIG. 3, which comprises the triangular conductor plates 31*a*, 31*a* and the feeder part 32.

Figure 9:
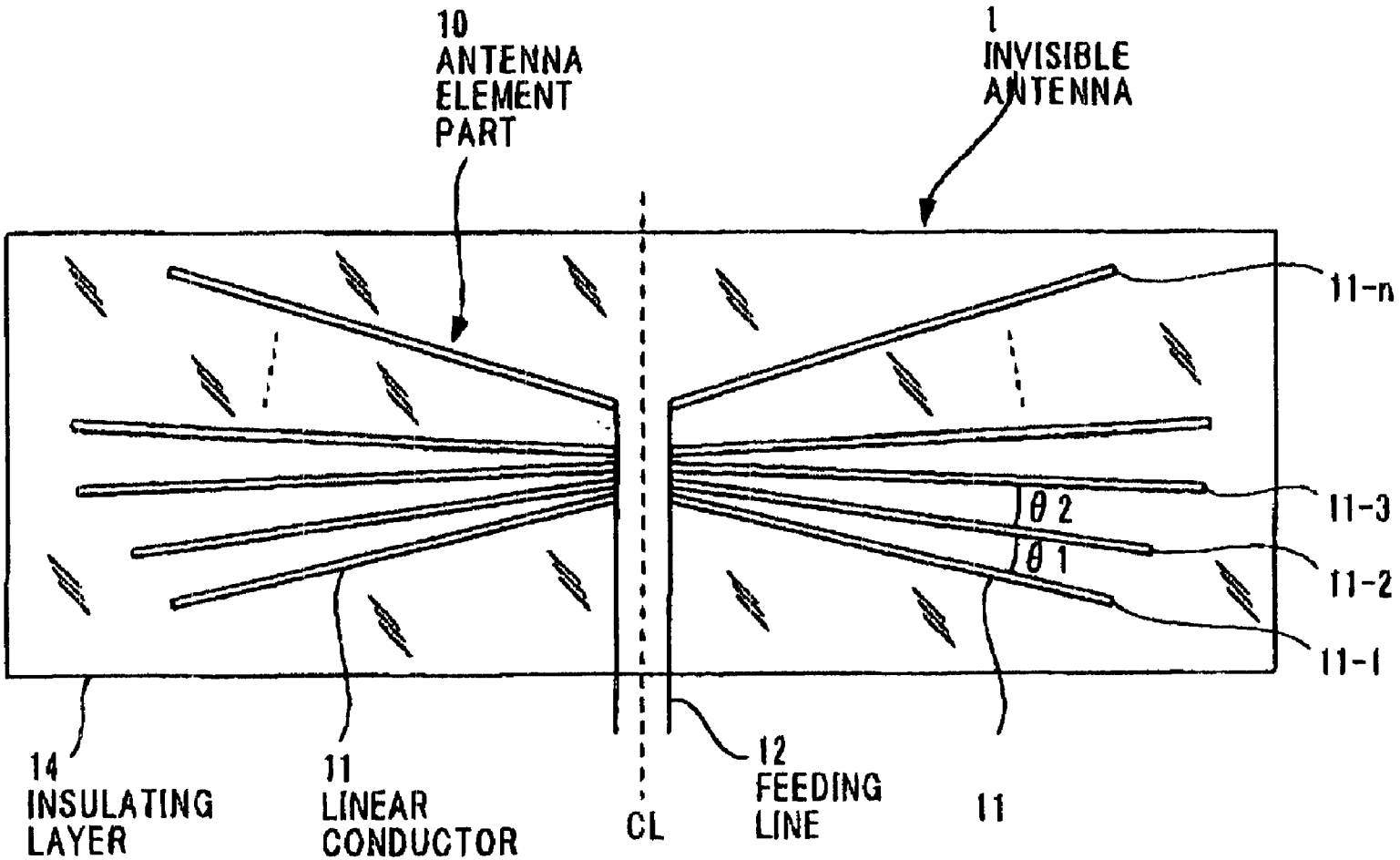
FIG. 9 is a plan view showing an invisible antenna in a third preferred embodiment according to the invention.

FIG. 9 is a plan view showing an invisible antenna in a third preferred embodiment according to the invention In FIG. 9, each of linear conductors 11 composing an antenna element part 10 is provided with an angle and a length different with each other to provide a substantially fan shape configuration to constitute an invisible antenna 1.

Similarly to the second preferred embodiment shown in FIG. 8, the angle of the each linear conductor 11 is an angle as regard to a predetermined reference line (e.g. centerline CL) provided on an insulating layer 14.

Further, the angles between the adjacent linear conductors 11 might be different with each other For example, adjacent linear conductors 11-1 and 11-2 are positioned with an angle $\theta_1$, and adjacent linear conductors 11-2 and 11-3 are positioned with an angle $\theta_2$, wherein the angles $\theta_1$ and $\theta_2$ are different with each other.

Still further, the angles between the adjacent linear conductors 11 might be equal with each other For example, the angle $\theta_1$ between the linear conductors 11-1 and 11-2 and the angle $\theta_2$ between the linear conductors 11-2 and 11-3 might be equal to each other.

Figure 4:
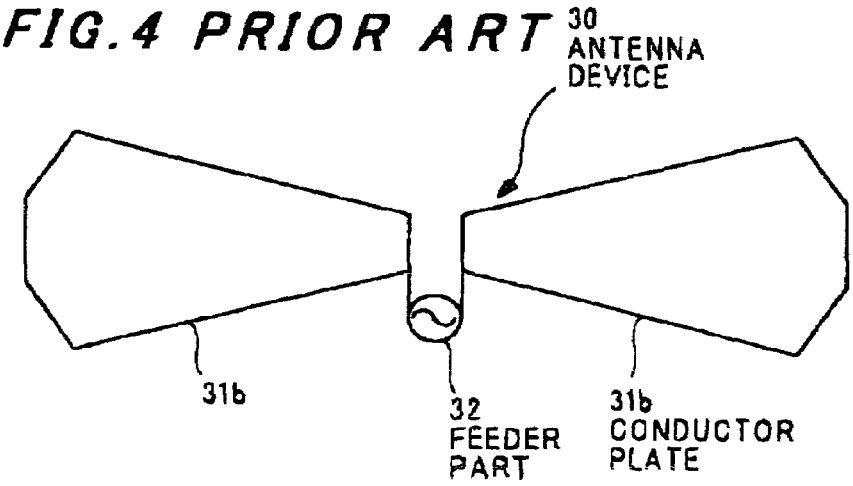
FIG. 4 PRIOR ART
FIG. 4 is a plan view showing another conventional dipole antenna having bow tie configuration.

According to the invisible antenna 1 in the third preferred embodiment, it is possible to achieve an operation similar to that of the conventional antenna device 30 (half wavelength dipole antenna) having a bow tie configuration shown in FIG. 4, which comprises the fan shape conductor plates 31*b*, 31*b* and the feeder part 32.

Figure 10A:
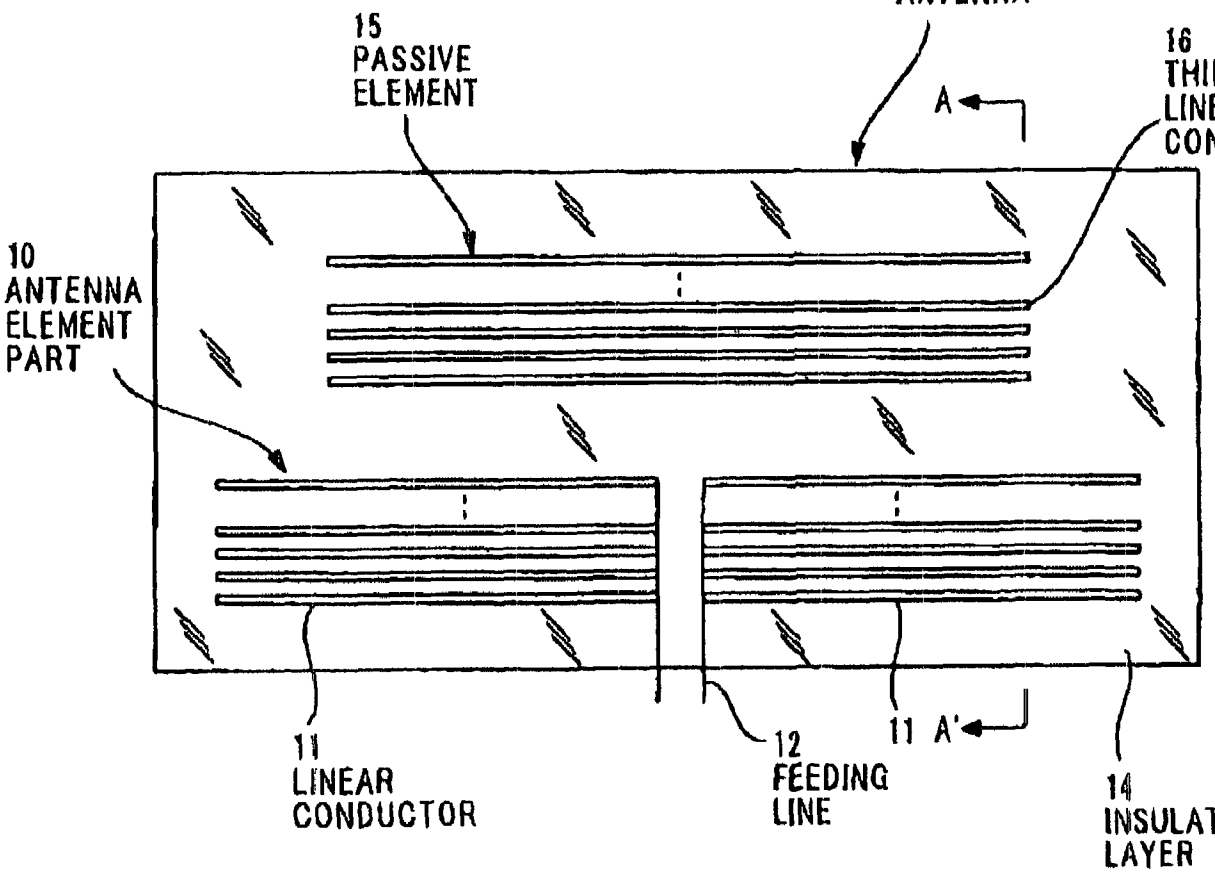
Figure 10B:
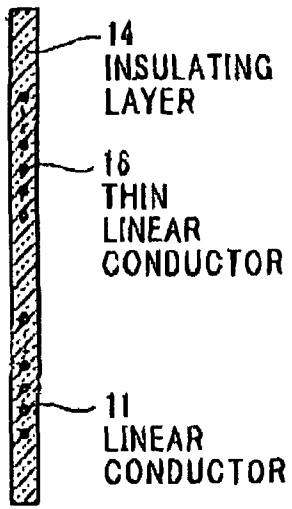

FIGS. 10A and 10B are diagrams showing an invisible antenna in a fourth preferred embodiment according to the present invention, wherein FIG. 10A is a plan view of the invisible antenna and FIG. 10B is a cross sectional view of the invisible antenna shown in FIG. 10A cut along line A-A'.

In FIG. 10A, a passive element 15 comprising thin linear conductors 16 disposed in parallel with an antenna element part 10 configured similarly to that in FIG. 6A is provided to form an invisible antenna 1.

Figure 2:
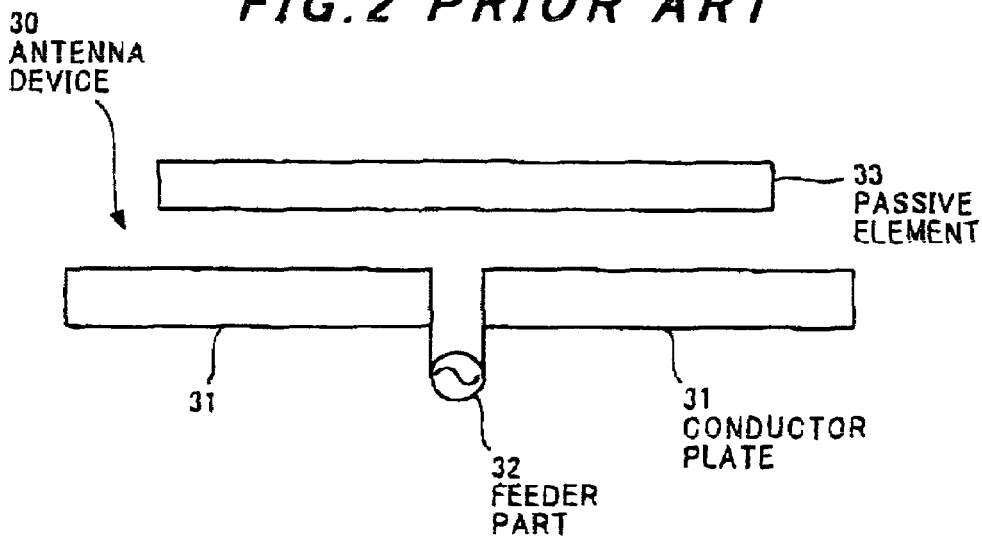
FIG. 2 PRIOR ART
FIG. 2 is a plan view showing a conventional dipole antenna, in which a passive element is disposed.

According to the invisible antenna 1 in the fourth preferred embodiment, it is possible to achieve an operation similar to the conventional antenna device 30 shown in FIG. 2.

Figure 11:
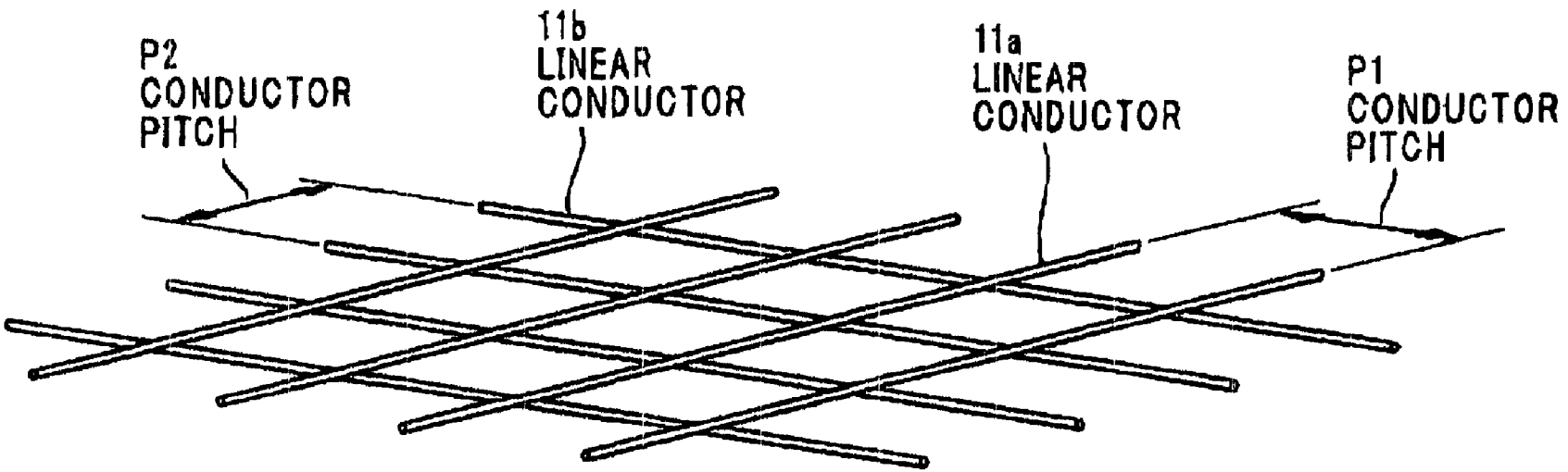
FIG. 11 is an enlarged perspective view showing the linear conductors of an invisible antenna in a fifth preferred embodiment according to the present invention.

FIG. 11 is an enlarged perspective view showing the linear conductors of an invisible antenna 2*n* a fifth preferred embodiment according to the present invention.

In FIG. 11, linear conductors 11*a*, 11*b* are positioned in crisscross arrangement. The linear conductors 11*a* are positioned in parallel with a conductor pitch $P_1$, and the linear conductors 11*b* are positioned in parallel with a conductor pitch $P_2$.

Figure 5:
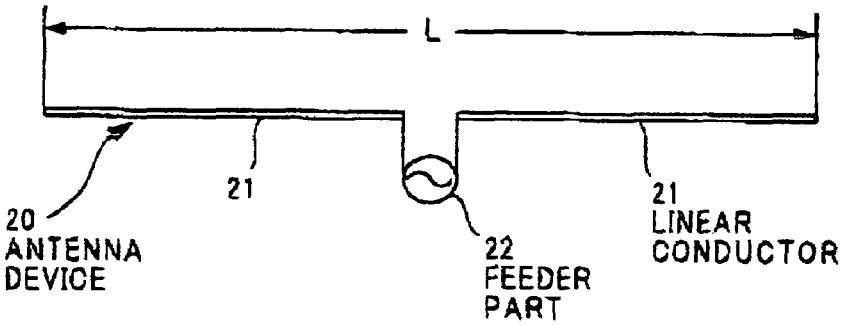
FIG. 5 is a plan view showing an example of an antenna device comprising linear conductors.

The antenna element 10 in FIGS. 6A, 8 and 9 and an antenna element comprising the linear conductors 21 in FIG. 5 may be replaced with these linear conductors 11*a*, 11*b* with appropriately connecting to a feeding line (not shown in FIG. 11).

Further, the passive element 15 in FIG. 10A may be replaced with these linear conductors 11*a*, 11*b* without connecting the feeding line.

According to an invisible antenna 1 using the crisscrossed linear conductors 11*a*, 11*b* in the fifth preferred embodiment, it is possible to achieve an operation similar to those in the antenna devices shown in FIGS. 5, 6A, 8 and 9.

For realizing the antenna devices in the first to fifth preferred embodiments in a manufacturing process, the thin linear conductors 11 may be disposed on and/or in the insulating layer 14 by a mechanical process. For example, the linear conductors 11 may be laminated between two layers of the insulating layers 14. The thin linear conductors 11 may be formed on and/or in the insulating layer 14 by a chemical process such as etching.

The invisible antenna of the present invention can be stuck on a glass window of a house, car, etc. as an antenna for receiving FM broadcasting, television broadcasting or antenna for wireless LAN transmission and reception.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching herein set forth.

What is claimed is:

1. An antenna having reduced visibility, comprising:

a feeding line;

an antenna element part connected to said feeding line, said antenna element part with said feeding line constituting said antenna; and a transparent insulating layer for mounting said antenna, wherein said antenna element part formed by a plurality of conductors in which a diameter of said conductors is 0.1 mm or less and a pitch between adjacent ones of said conductors is more than ten times of the diameter, and wherein said antenna comprises a half wavelength dipole antenna.

2. The antenna having reduced visibility, according to claim 1, wherein:

the conductor comprises a linear conductor.

3. The antenna having reduced visibility, according to claim 1, wherein:

a diameter of the conductor is 0.08 mm or less.

4. The antenna having reduced visibility, according to claim 1, wherein said antenna element part has one of a bow tie configuration and a substantially fan shape configuration, and wherein each of the conductors is provided with an angle different with each other to a reference line.

5. The antenna having reduced visibility, according to claim 4, wherein:

an angle between adjacent ones of the conductors is different with each other.

6. The antenna having reduced visibility, according to claim 4, wherein:

an angle between adjacent ones of the conductors is equal to each other.

7. The antenna having reduced visibility, according to claim 1, wherein:

the conductors are crisscrossed with each other.

8. The antenna having reduced visibility, according to claim 1, wherein:

a projection width of the conductor on a plane observed by the human eyes is 0.1 mm or less, and a pitch between adjacent ones of the conductors on the plane is more than ten times of a diameter of the conductor or the projection width of the conductor.

9. The antenna having reduced visibility, according to claim 8, wherein:

the projection width of the conductor is 0.08 mm or less.

10. The antenna having reduced visibility, according to claim 1, wherein:

said antenna element part has a rectangular configuration, and said conductors are disposed in parallel with each other.

11. The antenna having reduced visibility, according to claim 10, further comprising:

a passive element disposed in parallel to said antenna element part, said passive element being formed by other conductors.

* * * * *